US007743931B2

(12) United States Patent
Barkdoll

(10) Patent No.: US 7,743,931 B2
(45) Date of Patent: Jun. 29, 2010

(54) INVENTORY DISPLAY LOCK SYSTEM

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 121 days.

(21) Appl. No.: 11/288,916

(22) Filed: Nov. 29, 2005

(65) Prior Publication Data

US 2007/0119796 A1 May 31, 2007

(51) Int. Cl.
*E05B 73/00* (2006.01)

(52) U.S. Cl. ..... 211/7; 24/16 PB

(58) Field of Classification Search ..... 211/54.1, 211/57.1, 59.1, 7; 248/220.31, 220.42, 220.43, 248/220.41–3; 70/57.1, 16, 14, 58.18; 24/16 PB, 24/30.5 P, 484; 292/307 R, 307 A, 325, 30.5 P, 292/484

See application file for complete search history.

(56) References Cited

U.S. PATENT DOCUMENTS

| | | | | | |
|---|---|---|---|---|---|
| 712,765 | A | * | 11/1902 | Cole | 24/20 TT |
| 892,407 | A | * | 7/1908 | Coutney | 211/9 |
| 1,164,613 | A | * | 12/1915 | Jewell | 248/61 |
| 1,755,927 | A | | 4/1930 | Levinsohn | |
| 2,372,683 | A | * | 4/1945 | Robertson | 248/74.3 |
| 3,622,011 | A | | 11/1971 | Snow | |
| 3,906,592 | A | * | 9/1975 | Sakasegawa et al. | 248/68.1 |
| 4,027,798 | A | | 6/1977 | Swaim | |
| 4,063,646 | A | | 12/1977 | Stahl, Jr. | |
| 4,289,242 | A | | 9/1981 | Kenyon | |
| 4,394,909 | A | | 7/1983 | Valiulis et al. | |
| 4,510,649 | A | * | 4/1985 | Yudis et al. | 24/16 PB |
| 4,850,557 | A | | 7/1989 | Valiulis | |
| 5,009,334 | A | | 4/1991 | Bodkins | |
| 5,027,622 | A | | 7/1991 | Hatch et al. | |
| 5,075,932 | A | * | 12/1991 | Hunt et al. | 24/16 PB |
| 5,135,188 | A | * | 8/1992 | Anderson et al. | 248/74.3 |
| 5,259,220 | A | | 11/1993 | Fredrickson | |
| 5,275,027 | A | | 1/1994 | Eklof et al. | |

(Continued)

FOREIGN PATENT DOCUMENTS

| | | |
|---|---|---|
| WO | WO 03/080972 | 10/2003 |

OTHER PUBLICATIONS

TRION advertisement, "New ScanLock Cuts Theft"; Trion Industries, Inc., 297 Laird Street, Wilkes-Barre, Pennsylvania 18702-6997, Phone: 800.444.4665, Fax: 570.823.4080, info@triononline.ocm, www.triononline.com.

*Primary Examiner*—Katherine Mitchell
*Assistant Examiner*—Candace L. Bradford
(74) *Attorney, Agent, or Firm*—Reinhart Boerner Van Deuren P.C.

(57) ABSTRACT

A display lock a for securing merchandise on a display hook having at least two bars is provided. The display lock comprises, a clasp, a buckle, and a band. The clasp defines a channel sized closely to the outer periphery of one of the bars for a close fitting receipt of the bar. The projects away from the clasp and defines a detent region extending at least partially along the length of the band. The buckle is connected to the clasp. The buckle defines an aperture adapted to slidably receive the band and a catch engageable with the detent region of the band when the band is received in the aperture.

12 Claims, 9 Drawing Sheets

U.S. PATENT DOCUMENTS 5,524,463 A * 6/1996 Schenkel et al. ..... 70/57.1
5,594,228 A * 1/1997 Swartz et al. ..... 235/383
5,597,150 A 1/1997 Stein et al.
5,671,851 A 9/1997 Johnson et al.
5,711,432 A 1/1998 Stein et al.
6,044,669 A * 4/2000 Levi ..... 70/18
6,115,888 A * 9/2000 Kraus ..... 24/16 PB
6,226,839 B1 * 5/2001 Sayegh ..... 24/16 PB
6,311,531 B1 * 11/2001 Sykes ..... 70/57.1
6,364,124 B1 * 4/2002 Chen ..... 211/4
6,393,877 B1 5/2002 Church
6,474,478 B1 11/2002 Huehner et al.
6,598,433 B1 * 7/2003 Malvasio ..... 70/18
6,659,291 B2 * 12/2003 Huehner et al. ..... 211/4
6,845,577 B1 * 1/2005 Downes ..... 40/316
6,957,555 B1 * 10/2005 Nagel et al. ..... 70/57.1
7,197,902 B1 * 4/2007 Barkdoll ..... 70/57.1
2004/0026344 A1 * 2/2004 Sedon et al. ..... 211/7

* cited by examiner

INVENTORY DISPLAY LOCK SYSTEM

FIELD OF THE INVENTION

This invention generally relates to an inventory display lock, and more particularly to an inventory display lock for use with display hooks that are attached to a peg board for holding and displaying merchandise at a retail establishment.

BACKGROUND OF THE INVENTION

There are a variety of different types of display hooks that are presently in wide use. One type of display hook is a "scanner hook" of the type disclosed in U.S. Pat. No. 4,452,360 to Barnes. The scanner hook includes a lower horizontally extending hanger arm for supporting merchandise and an upper parallel arm for supporting a label that includes a price tag which may be "read" by an electronic scanning wand.

Unfortunately, these display hooks by themselves provided little or no theft deterrence to shoplifters. Particularly, shoplifters will steal product by a method know as sweeping. The shoplifter will "sweep" the entire product supported by the lower hanger arm from the display hook in a single motion into a container such as a purse or bag. This method of shoplifting occurs very quickly and results in a significant loss of product. Security display locks have been developed to prevent sweeping by securing or locking the merchandise on the display hook. Such display locks include U.S. Pat. No. 6,393,877 to Church, U.S. Pat. No. 5,275,027 to Eklof et al., and U.S. Pat. No. 5,027,622 to Hatch et al. The present invention relates to improvements in display locks as it relates to theft prevention, reliability, adaptability, practicality, ease-of-use, and/or cost effectiveness.

BRIEF SUMMARY OF THE INVENTION

In one aspect, the invention provides a display lock for securing merchandise on a display hook having at least two bars. The display lock comprises, a clasp, a buckle, and a band. The clasp defines a channel sized closely to the outer periphery of one of the bars for a close fitting receipt of the bar. The band projects away from the clasp and defines a detent region extending at least partially along the length of the band. The buckle is connected to the clasp. The buckle defines an aperture adapted to slidably receive the band and a catch engageable with the detent region of the band when the band is received in the aperture.

In another aspect, the invention provides a retail display lock system for displaying merchandise. The retail display lock system comprises a support, a display hook and a display lock. The display hook comprises a rear mount adapted to mount to the support, at least two bars extending forwardly from the rear mount and a stop disposed on at least one of the bars. The display lock comprises a band and a buckle, the band wrapping around at least partially the outer periphery of the at least two bars and engaged with the buckle.

In yet another aspect, the invention provides a retail display lock system comprising a retail display support, a display lock and merchandise. The retail display support having the merchandise supported thereon. The display lock comprises a band and a buckle. The band engageable with the buckle. The display lock being interposed among the merchandise and separating the merchandise into a secured portion that is not removable from the retail display support and an unsecured portion removable from the retail display support.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 3 shows a typical orientation of the system with the right side being the front, the left side being the rear, the top side being upward and the bottom side being downward.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
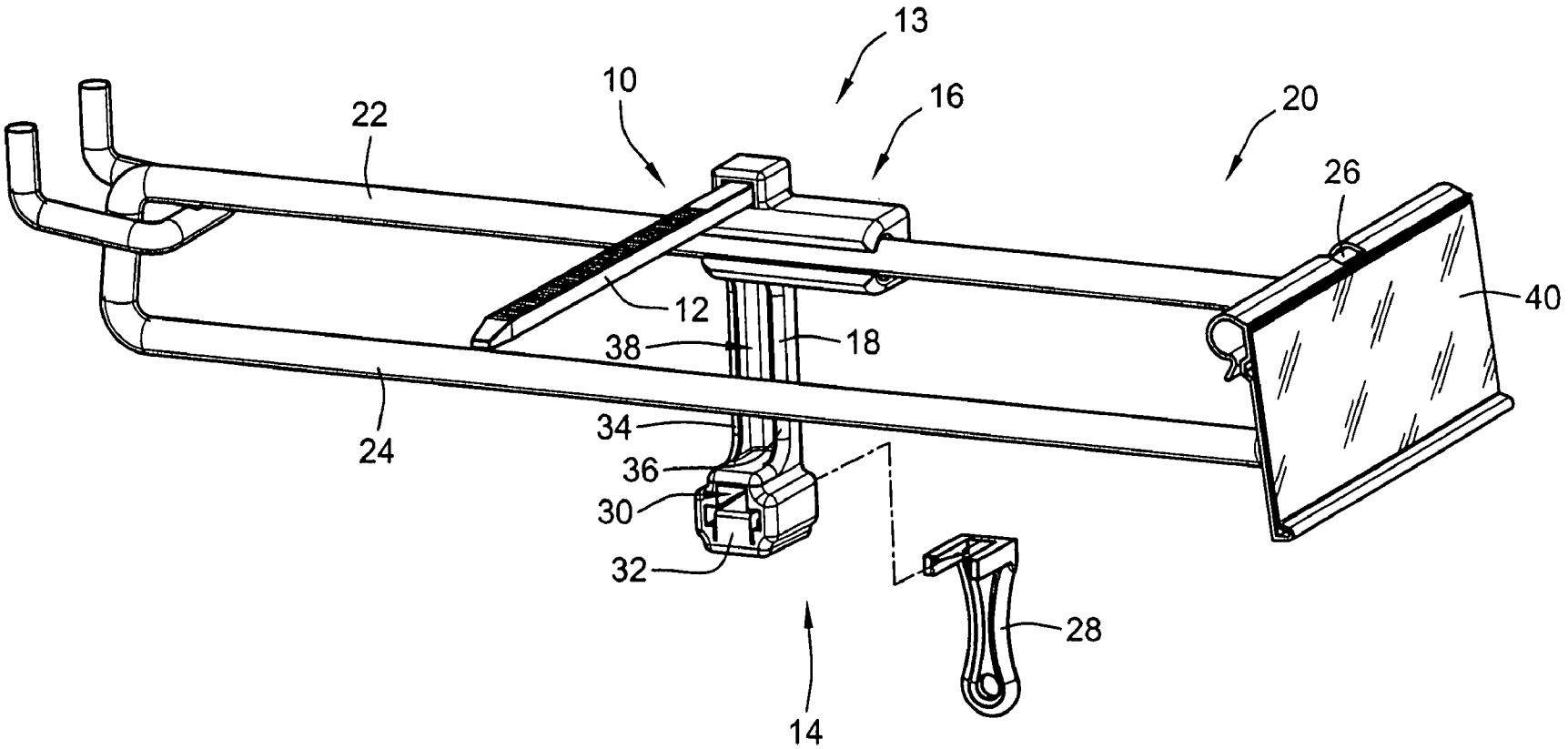
FIG. 1 is a perspective view of a display lock in an unlocked position disposed on a display hook according to an exemplary embodiment of the present invention.
Figure 2:
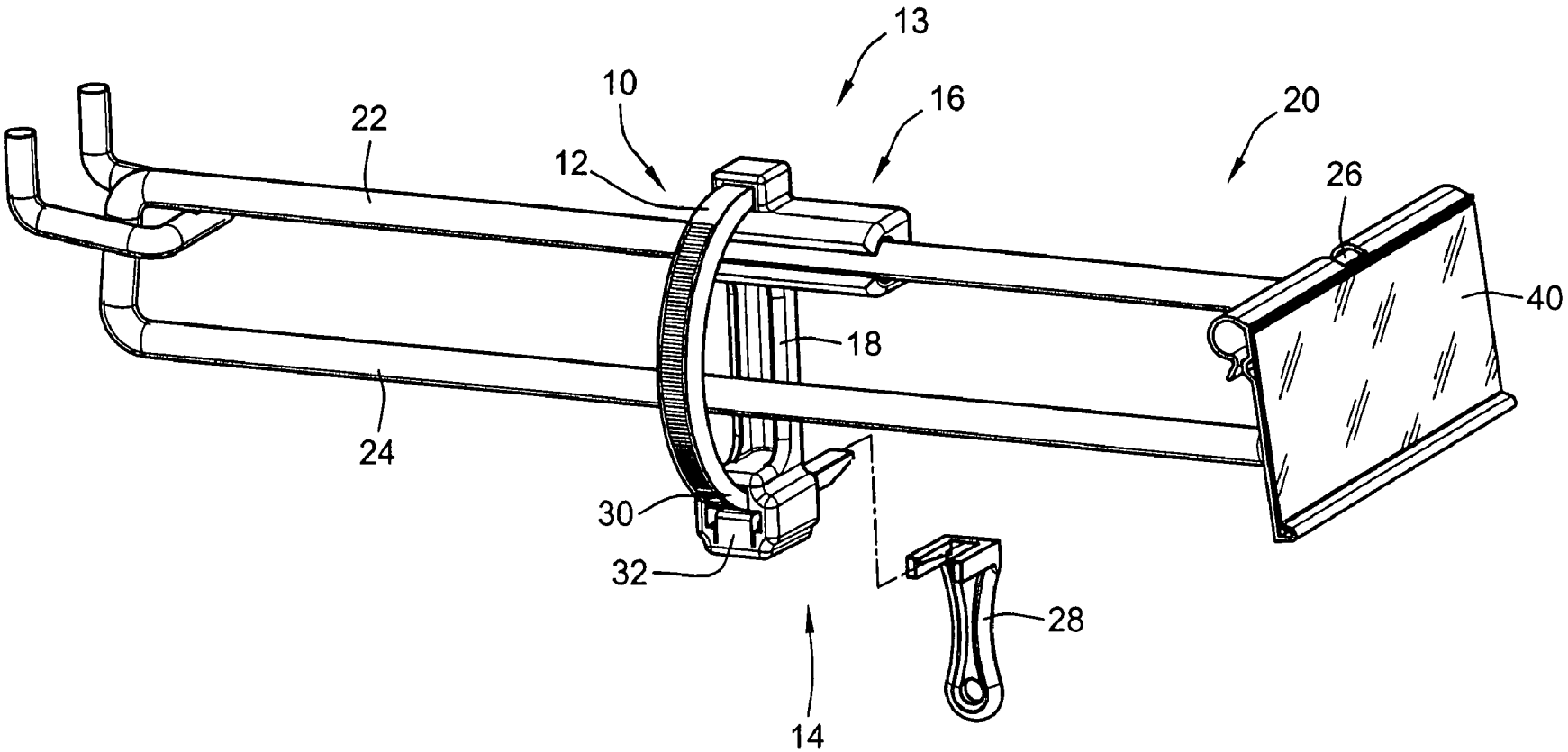
FIG. 2 is a perspective view of the display lock attached to the display hook in FIG. 1 and the display lock being in a closed position.

An exemplary embodiment of a display lock 10 in accordance with this invention is shown in FIG. 1. The display lock 10, shown in an open and unlocked position, generally includes two components a band 12 and a lock body 13. While the display lock 10 is shown as being made with two separate components, it will be appreciated that the lock may alternatively be molded of plastic as a single unitary component. The lock body 13 includes a buckle 14, a clasp 16 and an extension portion 18. The lock body 13 is preferably formed from molded plastic as a unitary body. The extension portion 18 is disposed between and connects the clasp 16 to the buckle 14. As illustrated in FIG. 2, the buckle 14 is adapted to slidably receive and releasably engage the band 12 when the display lock 10 is in a closed and locked position. The clasp 16 removably secures the display lock 10 to a display hook 20. When the display lock 10 is in the closed position and attached to a display hook 20, the display lock 10 forms a loop that wraps around and surrounds the outer periphery of the display hook 20. When locked, a key 28 can be used to release the band 12 from the buckle 14.

The display hook 20 is generally U-shaped and includes two horizontally extending bars 22, 24. The two bars are typically formed by bending a generally round rod into the U-shape. The top bar 22 is vertically disposed above the bottom bar 24, and the bars 22, 24 are generally parallel. The top bar 22 includes a stop 26 at a front end. In this figure, the stop 26 is a piece of round bar (better illustrated in FIG. 3) that extends substantially perpendicular to the plane defined by the top bar 22 and bottom bar 24. This stop 26 generally is used to attach a label holder 40. The label holder 40 snaps onto the stop 26 and is adapted to hold labels such as price tags or bar codes. Alternatively, the stop 26 could be a label holder, or other such abutment, fastened directly to the top bar 22. It should be noted that the display lock 10 of the disclosed invention can be used with display hooks having other configurations, particularly display hooks having two or more bars.

Figure 4:
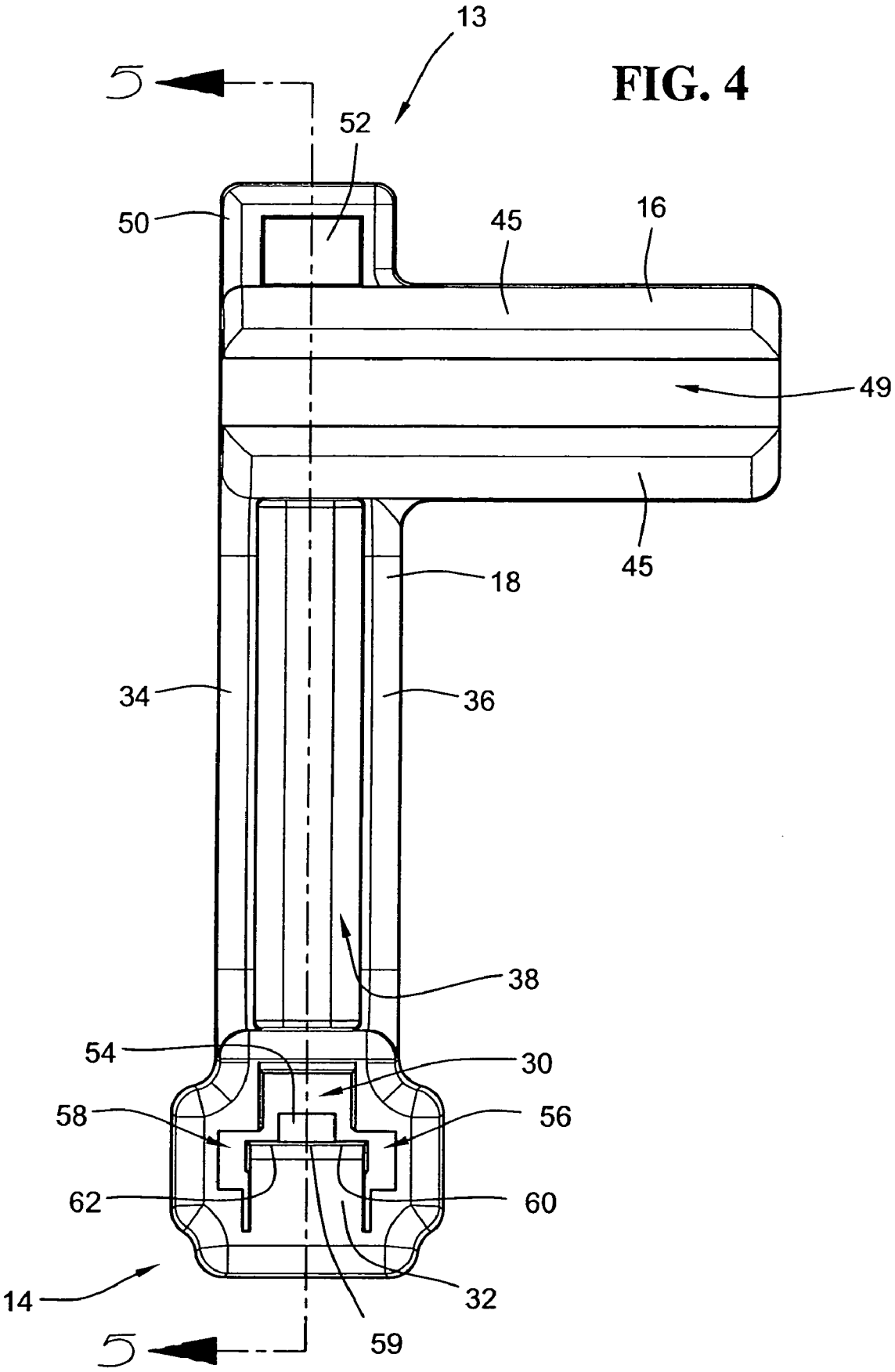
FIG. 4. is a front profile view of the body of the display lock in FIG. 1.
Figure 5:
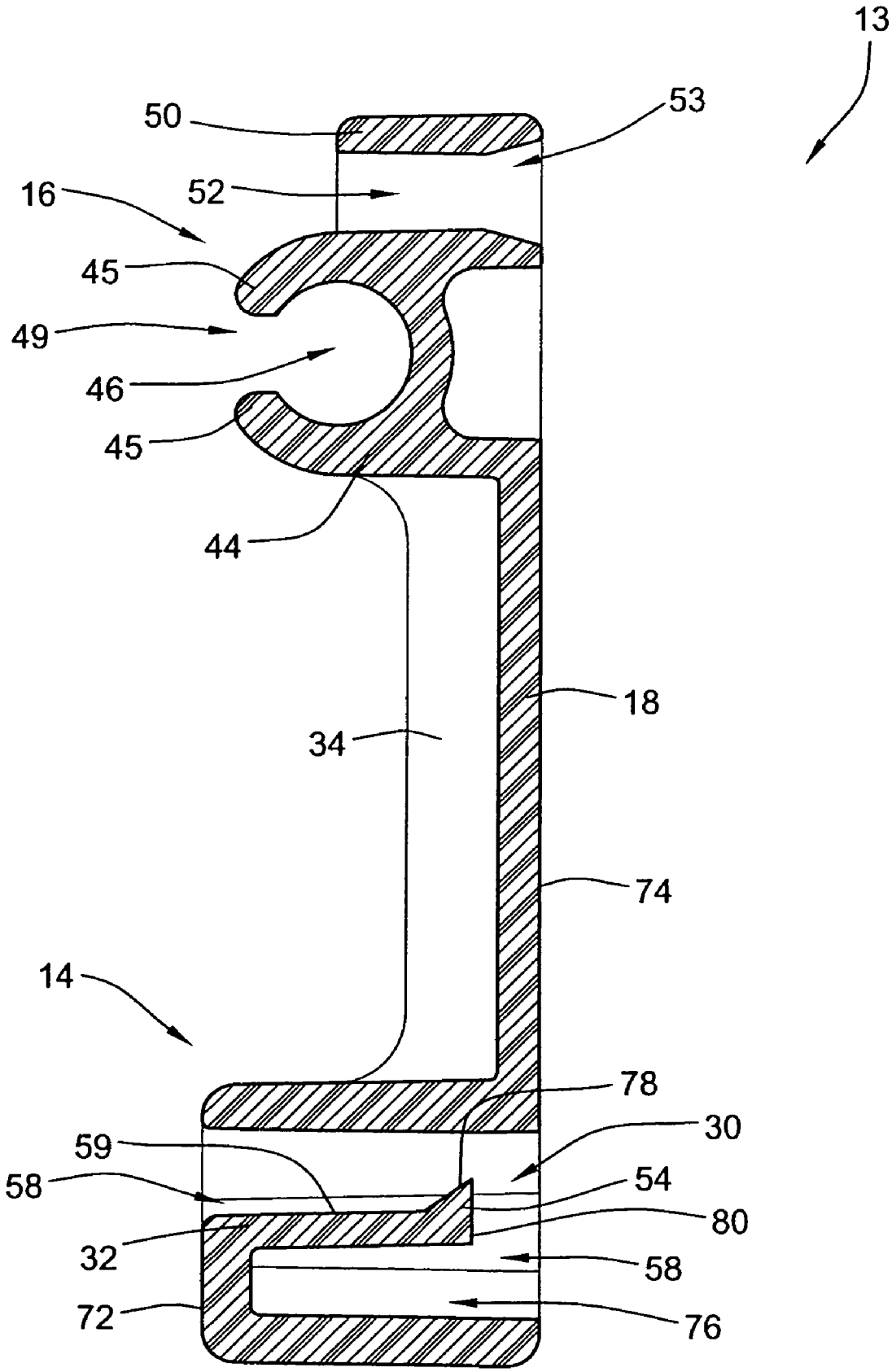
FIG. 5 is a cross-sectional view of the body of the display lock of FIG. 4.
Figure 9:
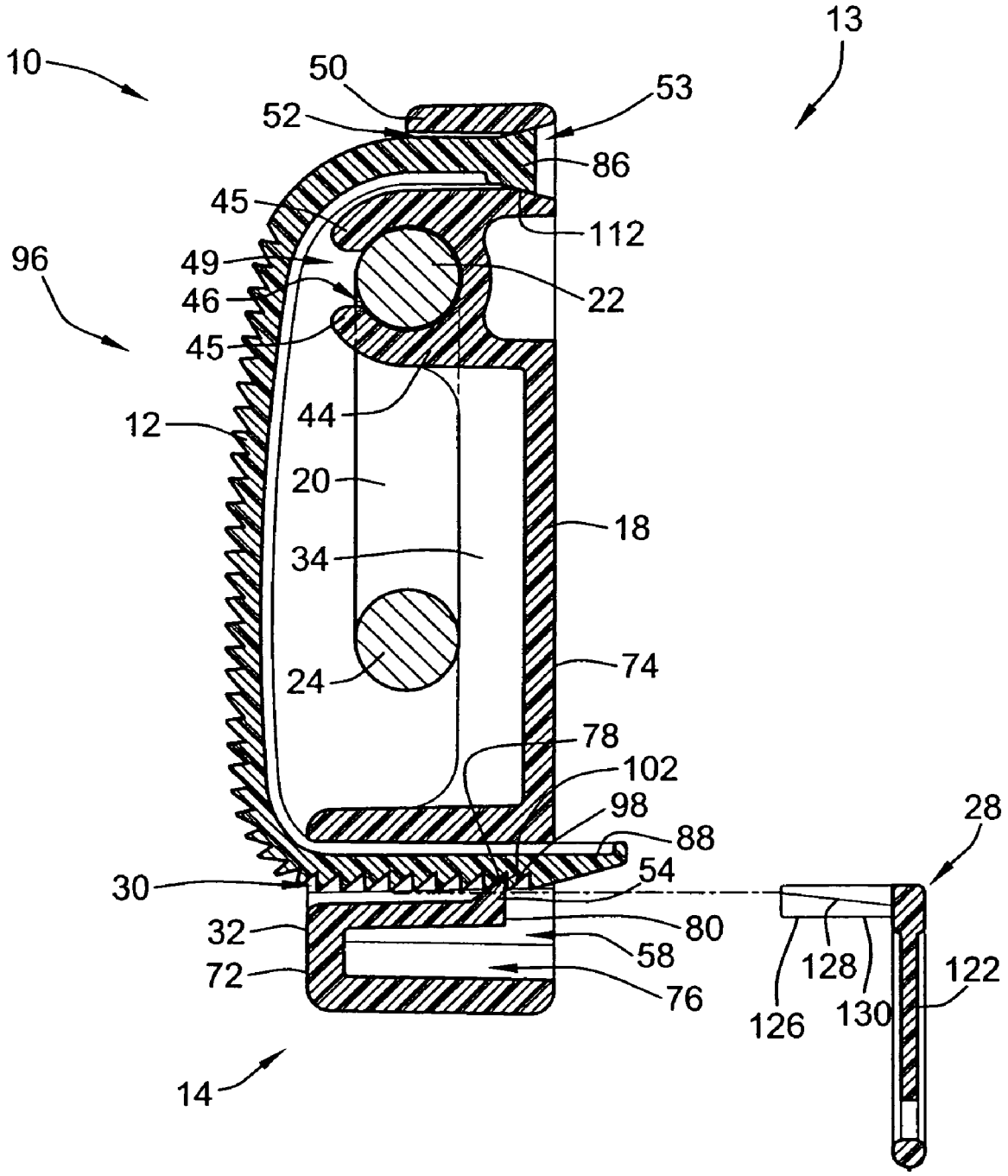
FIG. 9 is a cross-sectional view of the display lock on the display hook of FIG. 2 being in a closed position.

The clasp 16 snaps onto one of the bars 22, 24 and attaches the display lock 10 to the display hook 20. Referring to FIGS. 4 and 5, the clasp 16 extends laterally forward from the extension portion 18. The clasp 16 includes a substantially C-shaped structure 44 with opposed legs 45 that wrap substantially around the top bar 22 of the display hook 20 (FIGS. 1 and 9). The C-shaped structure 44 defines a longitudinally extending channel 46. The legs 45 of the C-shaped structure 44 further define a longitudinally extending opening 49 to the channel 46. The legs 45 of the C-shaped structure 44 are generally resilient. In this embodiment, the channel 46 is closely sized to receive the top bar 22 of the display hook 20 (FIGS. 1 and 9), such that the clasp 16 is snuggly fit onto the top bar 22 and there is no slop between the clasp 16 and the top bar 22. However, the clasp 16 may slide linearly along and slidably rotate about the top bar 22. The opening 49 between the legs 45 is sized to be smaller than the diameter of the top bar 22.

The combination of the resilient legs 45 and the opening 49 allows the clasp 16 of the display lock 10 to be snapped onto the top bar 22. As the legs 45 are pressed against the top bar 22, the legs 45 begin to spread resiliently allowing the top bar 22 to slide through the opening 49. As the top bar 22 begins to be substantially positioned within the channel 46, the legs 45 begin to bend resiliently back to their original position and partially surround and wrap around the top bar 22. This feature of the clasp 16 allows the display lock 10 to be snapped onto the top bar 22 at substantially any longitudinal position. It is preferable that that the resilient legs 45 of the clasp 16 to be sufficiently stiff and the opening 49 defined therebetween to be sufficiently narrow that significant effort is required to snap the clasp 16 onto the top bar 22. Likewise, and more importantly, this configuration is such that it takes significant effort and is difficult to remove the clasp 16 from the top bar 22. This increases and promotes the security features of the display lock 10, as will be more fully disclosed below.

With reference to FIGS. 4, 5, and 9, a raised rectangular portion 50 extends from the clasp 16. The raised portion 50 defines a generally rectangular aperture 52 sized to receive the band 12 therein. Furthermore, the entry 53 of the aperture 52 is beveled.

The extension portion 18 is disposed between and integrally connects the clasp 16 and the buckle 14 to define the lock body 13. The extension portion 18 includes two ribs 34 and 36 to increase its rigidity. The two ribs 34 and 36 form a channel 38 therebetween. The ribs 34 and 36 maintain rigidity while reducing material required to manufacture the lock body 13.

With further reference to FIGS. 4, 5 and 9, the buckle 14 is disposed at the opposite end of the extension portion 18 as the clasp 16. The buckle 14 includes an aperture 30 that extends entirely through the buckle 14. This aperture 30 is sized to slidably receive the band 12. The buckle 14 includes a prong 32 that extends into the aperture 30 in a cantilevered manner such that it can be biased. The prong 32 is a resilient member such that if it is bent or biased it returns back to its original pre-bent position and shape. The prong 32 includes a catch 54 which may take the form of a projection or indentation. In this embodiment, the catch 54 is a projection that extends from the top surface 59 of the prong 32 toward the center of the aperture 30. The top surface 59 of the prong 32 includes two shoulder portions 60 and 62. The shoulder portions 60 and 62 are spaced apart and separated by the catch 54. The aperture 30 of the buckle 14 further includes two channels 56 and 58 located adjacent to the shoulder portions 60 and 62 of the prong 32, respectively. The two channels 56 and 58 extend entirely through the buckle 14 from a front side 72 of the lock body 13 to a back side 74 of the lock body 13. The catch 54 includes a cam surface 78 and a shoulder 80. The cam surface 78 is slanted relative to the top surface 59 of the prong 32. The shoulder 80 is substantially perpendicular to the top surface 59. The buckle 14 further includes a cavity 76 located below the cantilevered portion of the prong 32 and the catch 54 that provides space in which the cantilevered prong 32 may be biased.

Figure 6:
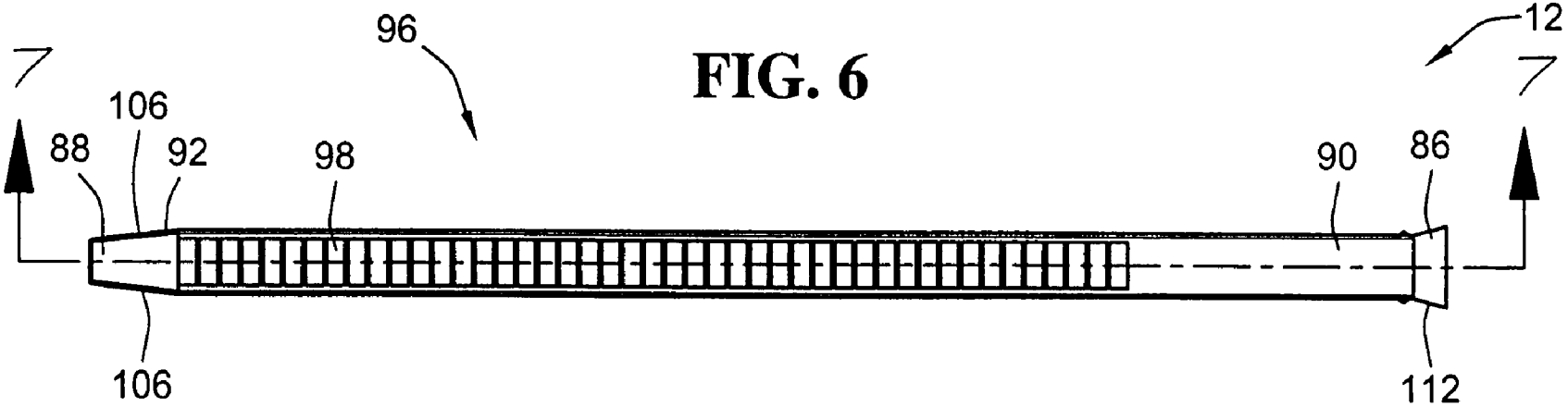
FIG. 6 is a top plan view of the band of the display lock of FIG. 1.
Figure 7:
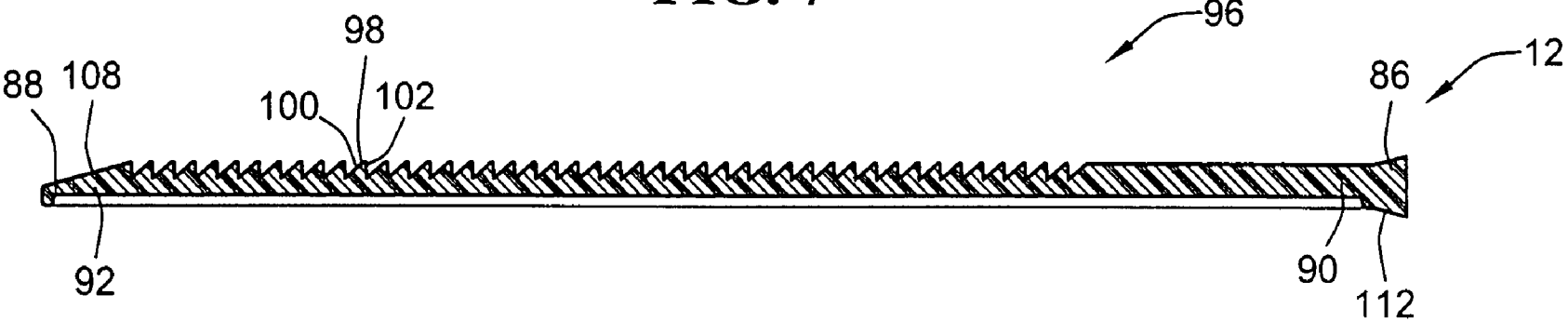
FIG. 7 is a cross-sectional view of the band of FIG. 6.

As seen in FIG. 9, the band 12 is attached to the lock body 13 by the aperture 52 defined by the raised portion 50 extending vertically from the clasp 16. The band 12 is inserted into the aperture 52 through the beveled opening 53 located on the back side 74 of the lock body 13. The band 12 of the display lock 10 is best illustrated in FIGS. 6, 7 and 9. The band 12 is generally made of a flexible and resilient material such as plastic and extends longitudinally between a head 86 at a first end 90 and a snout 88 at a second end 92. The band 12 has a detented region 96 disposed between the head 86 and snout 88. The detented region 96 extends a substantial length of the band 12 and is defined by structure which provides multiple locking positions such as a plurality of similarly sized teeth 98. Each tooth has a triangular profile defined by a cam surface 100 and a catch shoulder 102. The cam surface 100 is slanted relative to the band 12 and the catch shoulder 102 is generally perpendicular to the band 12. The plurality of teeth 98 extend transverse relative to the length of the band 12 defined between the head 86 and snout 88.

The snout 88 has slanted sides 106 and a tapered top surface 108. The tapered profile of the snout 88 aids insertion into the aperture 30 of the buckle 14 as well as the beveled entry 53 of aperture 52 defined by raised portion 50. The head 86 of the band 12 is defined by four flared sides 112. The flared sides 112 of the head 86 prevent the band 12 from being pulled completely through the aperture 52 and are configured to mate with the beveled entry 53 of the aperture 52 when the band 12 is inserted therethrough.

In operation, the display lock 10 in the closed position forms a loop, as shown in FIG. 9. The loop is formed generally by the band 12 and the lock body 13. The loop surrounds the outer periphery of the display hook 20 defined by the top bar 22 and bottom bar 24.

The band 12 is inserted through the beveled entry 53 of the aperture 52 of the raised portion 50 as well as through the aperture 30 of the buckle 14. The band 12 is inserted into the aperture 30 of the buckle 14 on the front side 72 of the lock body 13 and extends through the aperture 30 until it exits the buckle 14 at the back side 74 of the lock body 13. As the band 12 is pulled through the buckle 14, the loop gets smaller and is tightened around the outer periphery of the display hook 20. It is a feature of the present embodiment that as the band 12 is selectively tightened around the outer periphery of the display hook 20, the band 12 assists in securing the clasp 16 onto the top bar 22 by partially blocking the opening 49 of the clasp 16, as seen in FIG. 9.

The band 12 is releaseably engaged by the prong 32 of the buckle 14 when the display lock 10 is in a closed position. As the band 12 passes through the aperture 30, the detented region 96 of the band 12 passes over the catch 54 of the prong 32. As the detented region 96 passes over the catch 54, successive cam surfaces 100 of successive teeth 98 slidingly contact the cam surface 78 of the catch 54 and resiliently bias the prong 32 downward toward the cavity 76.

The catch shoulder 80 of the catch 54 and the catch shoulder 102 of one of the teeth 98 prevent the band 12 from being pulled in an opposite direction, i.e. in a direction extending from the back side 74 of the lock body 13 to the front side 72 of the lock body 13. As the band 12 is loaded in that direction, the band 12 is prevented from moving because the catch shoulder 102 of the tooth 98 abuts with the catch shoulder 80 of the catch 54. Because these two shoulders 80 and 102 in this embodiment are substantially perpendicular to the direction of travel and parallel to each other, no vertical force is imposed on the prong 32 to bias the prong 32 and allow the tooth 98 to pass by the catch 54. In fact, attempting to remove the band 12 tends to cause the prong 32 and catch 54 to engage even tighter with the band 12, particularly if the catch shoulders 80 and 102 are slanted such that the shoulder of the tooth imposes a vertical force onto the shoulder of the catch.

Figure 8:
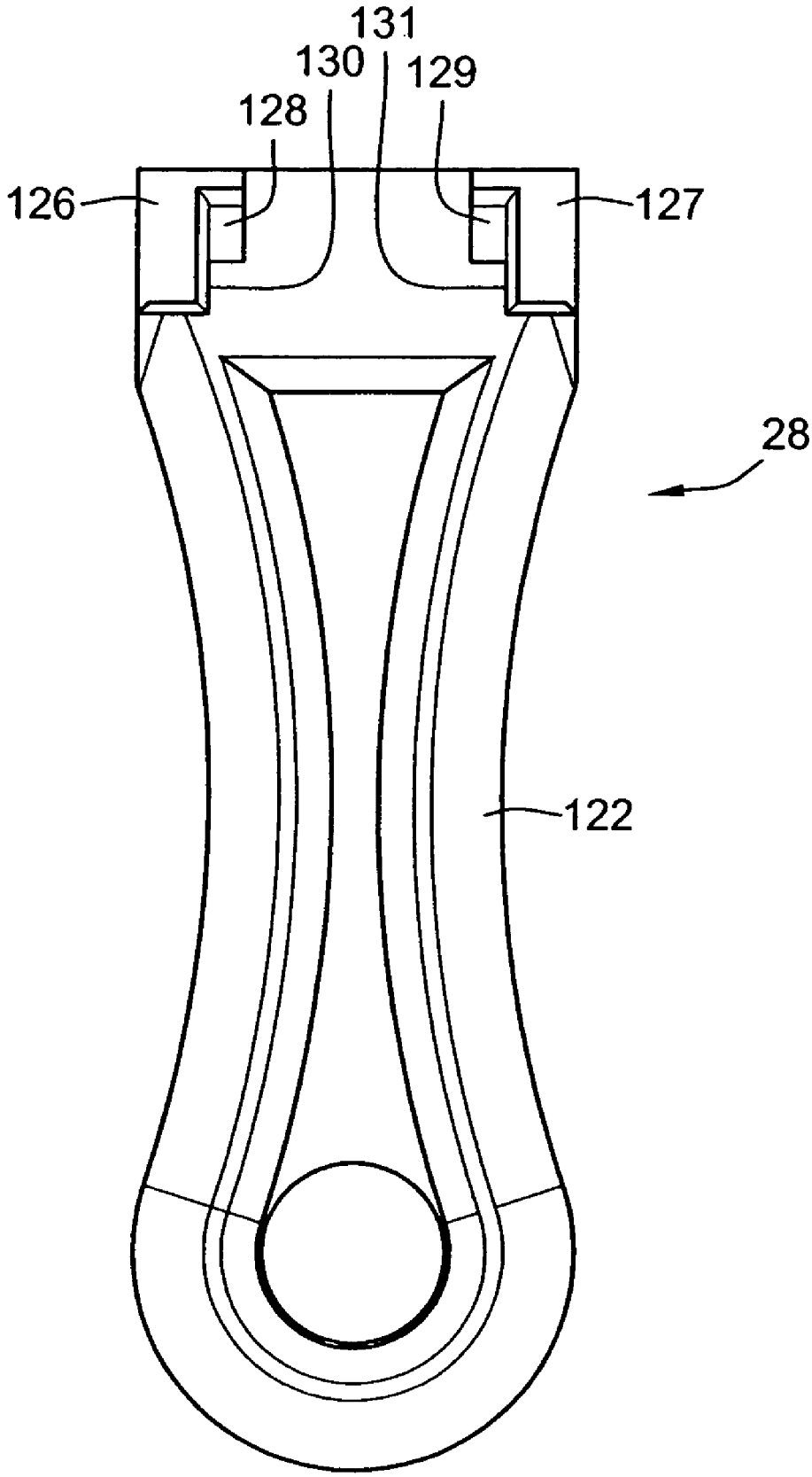
FIG. 8 is a front profile view of the key for the display lock, shown in FIG. 1.

The band 12 can be released from the buckle 14 by using the key 28. The key 28 is used to bias the prong 32 into cavity 76 and away from the band 12 to disengage the detented region 96. The key 28, as shown in FIG. 8, includes a handle 122 and a pair of spaced apart guide members 126, 127. The guide members 126, 127 are sized to be inserted into the channels 56, 58 adjacent to the prong 32 of the buckle 14 (FIG. 4). The guide members 126, 127 include slanted biasing surfaces 128, 129, respectively. The biasing surfaces 128, 129 extend laterally toward each other from the sides 130, 131 of the guide members 126, 127, respectively. The guide members 126, 127 are spaced apart such that the biasing surfaces 128, 129 straddle the catch 54 of prong 32 when the key 28 is inserted into the buckle 14.

As best understood with reference to the cross-sectional illustration in FIG. 9, guide member 126 of the releasing key 28 inserts into the buckle 14 from the back side 74 of the lock body 13. The guide member 126 slides through channel 58 in the buckle 14 and adjacent to the prong 32. As the key 28 is inserted further into the buckle 14, the biasing surface 128 begins to slidingly contact the shoulder portion 62 (FIG. 4) of the prong 32. As the releasing key 28 is further inserted into the buckle, the cam surface 128 acts as a wedge and biases the prong 32 as well as the catch 54 away from the band 12. When the key 28 is inserted sufficiently into the buckle 14 such that the prong 32 and catch 54 no longer interfere with or contact the shoulders 102 of any of the teeth 98, the band 12 can be removed from the buckle 14. After the band 12 has been removed from the aperture 30, the key 28 can be removed from the buckle 14. When the key 28 is removed, the prong 32 resiliently bends back to its original position such that if the band 12 is reinserted into the aperture 30, the catch 54 will engage again the teeth 98 of the band 12.

Figure 3:
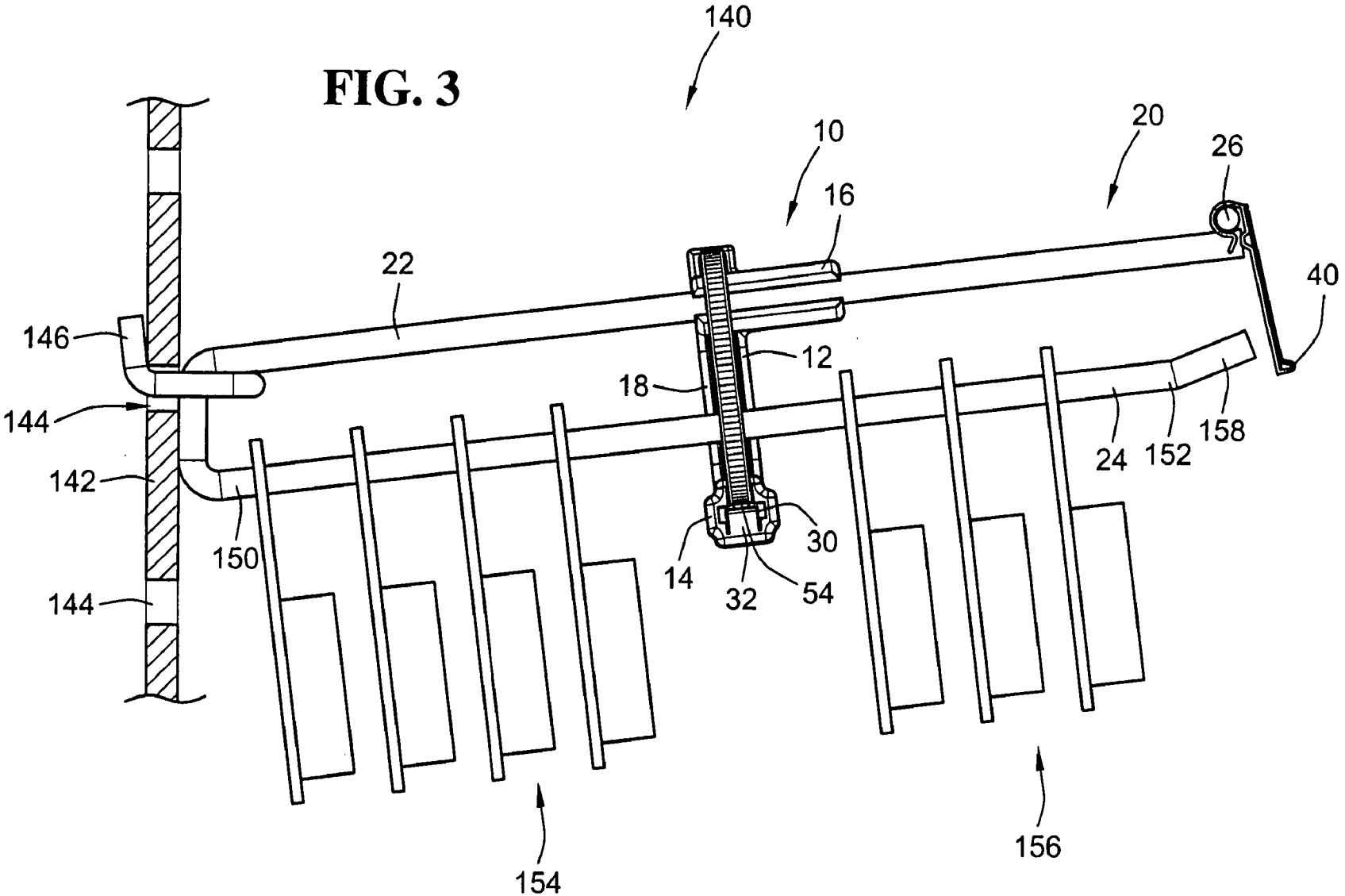
FIG. 3 is a side profile view of the display lock similar to FIG. 2 disposed on a display hook carrying merchandise and mounted on a vertically extending peg board.

A display system 140 utilizing the previously described display lock is shown in FIG. 3. The display system generally includes a display lock 10, a display hook 20, a support 142, a first portion of merchandise 154 and a second portion of merchandise 156. The support 142 in this display system 140 is a vertically extending peg board that includes a plurality of apertures 142. The display hook 20 is similar to that explained above. The display hook 20 further includes a mounting mechanism 146 at a first end 150 of the display hook 20. The bottom bar 24 includes a bent up portion 158 at a second end 152 of the display hook 20. The mounting mechanism 146 is used to attach the display hook 20 to the support 142 by extending through apertures 144 of the support 142. The bent up portion 158 helps prevent the second portion of merchandise 156 from being removed from the bottom bar 24 of the display hook 20. The stop 26 attached to the top bar 22 prevents the display lock 10 from being slid off of the top bar 22 at the second end 152. Further, the display lock 10 may be slid along the top bar 22 between the stop 26 and the mounting mechanism 146.

The display lock 10 is shown in a closed position, such that the band 12 is inserted into aperture 30 of the buckle 14 and engaged by prong 32. The display lock 10 is attached to the top bar 22 of the display hook 20 and is positioned such that it separates the first portion of merchandise 154 from the second portion of merchandise 156. It is a feature of one application of the display system that the display lock 10 prevents the first portion of merchandise 154 from being removed from the display hook 20, while the second portion of merchandise 156 is free to be removed from the display hook 20. Alternatively, the display lock 10 can also be used to lock all of the merchandise on the display hook.

Figure 10:
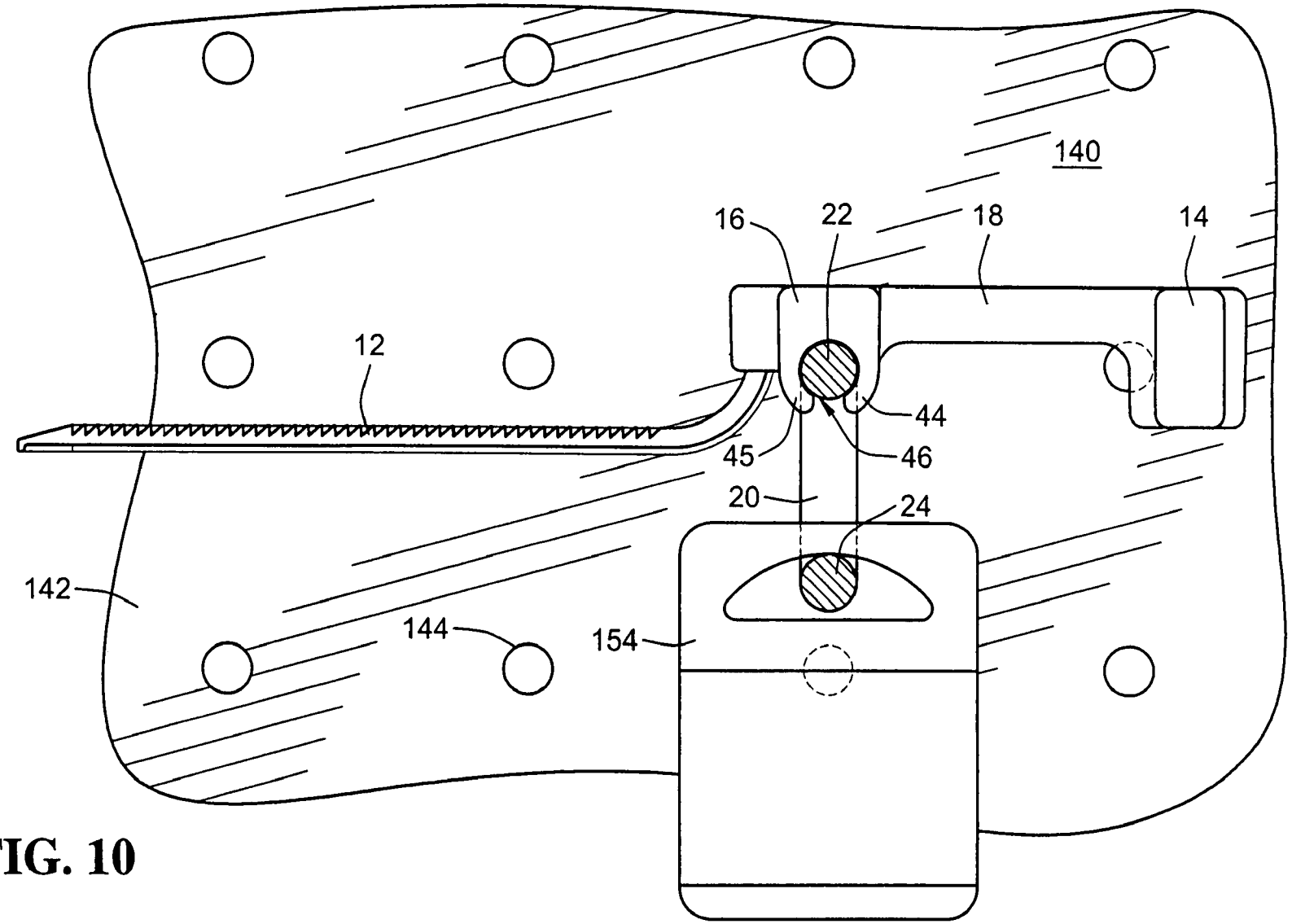
FIG. 10 is a front profile view of the display lock on a display hook similar to FIG. 3, but having the display lock in an open position and illustrating the display lock rotated out of the way such that it does not impede the merchandise carried on the display hook from being removed.

After the second portion of merchandise 156 is completely removed from the display hook 20, the band 12 can be released using the releasing key 28 and the display lock 10 put in its open position. While in the open position, the display lock 10 may be rotated about the top bar 22 such that the band 12 and body 13 are out of the way of the first portion of merchandise 154, as shown in FIG. 10. A portion of the first portion of merchandise 154 may then be moved to the position where the second portion of merchandise 156 had previously been (see FIG. 3). Alternatively, the display lock 10 may be slid axially along the top bar 22 to a new position and then inserted between portions of the first portion of merchandise 154. This now allows a portion of the previously permanently secured merchandise 154 to be available for a consumer to purchase.

As explained above, the configuration of the clasp 16 makes it difficult to remove the display lock 10 from the top bar 22. This difficulty of removal increases security of the first portion of merchandise 154 because the display lock 10 prevents that merchandise from being removed from the display hook 20.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display lock system for displaying merchandise, comprising:

a display hook comprising a rear mount adapted to mount to a support, at least two bars extending forwardly from the rear mount, and a stop disposed on at least one of the bars;

a display lock comprising a band and band, a buckle, a clasp defining a channel slidably receiving one of the at least two bars, and a rigid extension body portion projecting generally vertically between the clasp and the buckle and integrally connecting the clasp and the buckle forming a single continuous piece including the clasp, the buckle, and the rigid extension portion;

the band wrapping around at least partially the outer periphery of each of said at least two bars and engaged with the buckle;

wherein the band defines a detent region extending at least partially along the length on a single side thereof, and wherein the buckle defines an aperture slidablv receiving the band, and a catch engaged with the detent region preventing removal of the band from the aperture; and wherein the clasp is an elongated C-shaped member including a channel having a narrowed opening thereto defining undercuts such that the clasp snap fits onto the top bar, the band overlapping the narrowed opening of the C-shaped member when the detent region is slidably received in the buckle and the catch is engaged with the detent region.

2. The display lock system of claim 1, wherein the stop is proximate a front end of at least one of the bars preventing the display lock from sliding off the display hook, the display lock being slidable between the rear mount and the stop.

3. The display lock system of claim 2, wherein the at least two bars comprise a top bar and a bottom bar disposed vertically under the top bar, and wherein the clasp is linearly slidable on the top bar.

4. The display lock system of claim 3, wherein the stop is a sign holder.

5. The display lock system of claim 1, wherein the display lock is formed entirely of molded plastic.

6. The display lock system of claim 1, wherein the at least two bars comprise a top bar and a bottom bar disposed vertically under the top bar, the merchandise being carried on the bottom bar, and wherein the display lock impedes a first portion of the merchandise from being removed from the display hook while a second portion of the merchandise is free to be removed from the display hook.

7. The retail display lock system of claim 1, wherein the catch comprises a resilient prong projecting inward from the body of the buckle toward a center of the aperture and having a cam surface and a catch portion, and wherein the detent region comprises a plurality of teeth extending transverse relative to a length of the band and each tooth having a cam surface and a catch portion such that as the band is slidably received in the aperture in a first direction the sliding surface of successive teeth successively contacts the sliding surface of the prong and resiliently bias the prong to permit passage of the band in the first direction and such that when the band is loaded in an opposite direction, the catch portion of one tooth engages the catch portion of the prong resisting movement in the opposite direction.

8. The display lock system of claim 7, further comprising a key having at least one wedge portion sized to be receivable in the aperture and configured to bias the prong such that the catch portion of the prong disengages the catch portion of said one tooth thereby allowing movement in said opposite direction.

9. The retail display lock system of claim 1, wherein a portion of the loop defined by the band has an internal dimension that is large enough to simultaneously receive the at least two bars therein.

10. A retail display lock system, comprising:

a retail display support including a rod elongated along an axis;

a display lock comprising a flexible band and a buckle, the band engageable with the buckle;

wherein the display lock forms a loop when the band and the buckle are engaged that extends around the retail display support, the display lock further comprises a detent region formed on a single side of the band and a catch of the buckle selectively engageable with the detent region for adjusting a size of the loop and selectively tightening the loop around the retail display support;

the display lock further comprises a clasp configured to attach the display lock to the retail display support, the clasp defining an elongated channel through which the rod extends along the axis when the display lock is mounted to the retail display support, the channel including a narrowed mouth opening in a side of the clasp for laterally mounting the display lock onto the rod in a direction generally perpendicular to the axis of the rod, the flexible, band overlapping the narrowed mouth when the detent region is engaged with the catch, such that the narrowed mouth is internal to the loop;

wherein the detent region includes a plurality of teeth extending transverse to a length of the band and the buckle includes an aperture sized to slidably receive the band and the catch includes a prong for engaging the plurality of teeth; and wherein the retail display support is a display hook.

11. The retail display lock system of claim 10, wherein the display lock is made entirely from plastic.

12. A retail display lock for securing merchandise on a display hook having at least two bars extending generally along an axis, the display lock comprising:

a clasp defining a channel sized for receipt of one of said bars along the axis, the clasp being a channel having a narrowed mouth formed in a side thereof for laterally mounting the display lock onto the one of said bars in a direction being generally perpendicular the axis;

a flexible band projecting away from the clasp, the band defining a detent region extending at least partially along the length on a single side thereof; and a buckle connected to the clasp, the buckle defining an aperture adapted to slidably receive the band, and a catch engageable with the detent region when the band is received in the aperture; and wherein the band includes a first end that is fixed proximate the clasp in a fixed orientation and position and a second free end, the second free end receivable through the aperture in a first direction and engaging a catch therein such that the band is prevented from being removed from the buckle prior to disengagement of the buckle from the band, the buckle selectively engageable with the detent region to flexibly adjust a size of a loop that surrounds the at least two bars when the display lock is mounted thereto, the loop being formed, at least in part, by the band; and wherein a portion of the band included in the loop overlaps the mouth of the channel when the loop is formed and the band is engaged with the buckle.

* * * * *

UNITED STATES PATENT AND TRADEMARK OFFICE

CERTIFICATE OF CORRECTION

PATENT NO. : 7,743,931 B2
APPLICATION NO. : 11/288916
DATED : June 29, 2010
INVENTOR(S) : Patrick J. Barkdoll It is certified that error appears in the above-identified patent and that said Letters Patent is hereby corrected as shown below:

In column 8, line 51, "flexible," should be changed to -- flexible --.

Signed and Sealed this

Twenty-fourth Day of August, 2010

David J. Kappos

David J. Kappos
*Director of the United States Patent and Trademark Office*